US005924855A

United States Patent [19]

Dahmlos et al.

[11] Patent Number: 5,924,855

[45] Date of Patent: Jul. 20, 1999

[54] SCREW COMPRESSOR WITH COOLING

[75] Inventors: Christian Dahmlos, Kremperheide; Dietmar Rook, Lägerdorf; Ralf Steffens, Lohbarbek, all of Germany

[73] Assignee: SIHI Industry Consult GmbH, Itzehoe, Germany

[21] Appl. No.: 08/981,322

[22] PCT Filed: Jun. 18, 1996

[86] PCT No.: PCT/EP96/02631

§ 371 Date: Dec. 15, 1997

§ 102(e) Date: Dec. 15, 1997

[87] PCT Pub. No.: WO97/01038

PCT Pub. Date: Jan. 9, 1997

[30] Foreign Application Priority Data

Jun. 21, 1995 [DE] Germany ..... 195 22 557
Jun. 21, 1995 [DE] Germany ..... 195 22 559

[51] Int. Cl.[6] ..... F04C 29/04

[52] U.S. Cl. ..... 418/91; 418/201.1

[58] Field of Search ..... 418/201.1, 91

[56] References Cited

U.S. PATENT DOCUMENTS

| | | | |
|---|---|---|---|
| 3,289,600 | 12/1966 | Whitfield | 103/128 |
| 3,795,117 | 3/1974 | Moody, Jr. et al. | 62/197 |
| 4,515,540 | 5/1985 | Pillis | 418/97 |
| 4,917,583 | 4/1990 | Frings et al. | 418/206 |
| 5,269,667 | 12/1993 | Mauney | 418/201.1 |
| 5,295,798 | 3/1994 | Maruyama et al. | 418/201.1 |

FOREIGN PATENT DOCUMENTS

| | | | |
|---|---|---|---|
| 0 290 664 A1 | 11/1988 | European Pat. Off. | F04C 29/04 |
| 25 44 082 | 4/1977 | Germany | F04C 29/04 |

*Primary Examiner*—Timothy S. Thorpe
*Assistant Examiner*—Ehud Gartenberg
*Attorney, Agent, or Firm*—Alix, Yale & Ristas, LLP

[57] ABSTRACT

The invention provides a two-rotors screw compressor having active cooling means on the pressure side of the motive rotor.

12 Claims, 1 Drawing Sheet

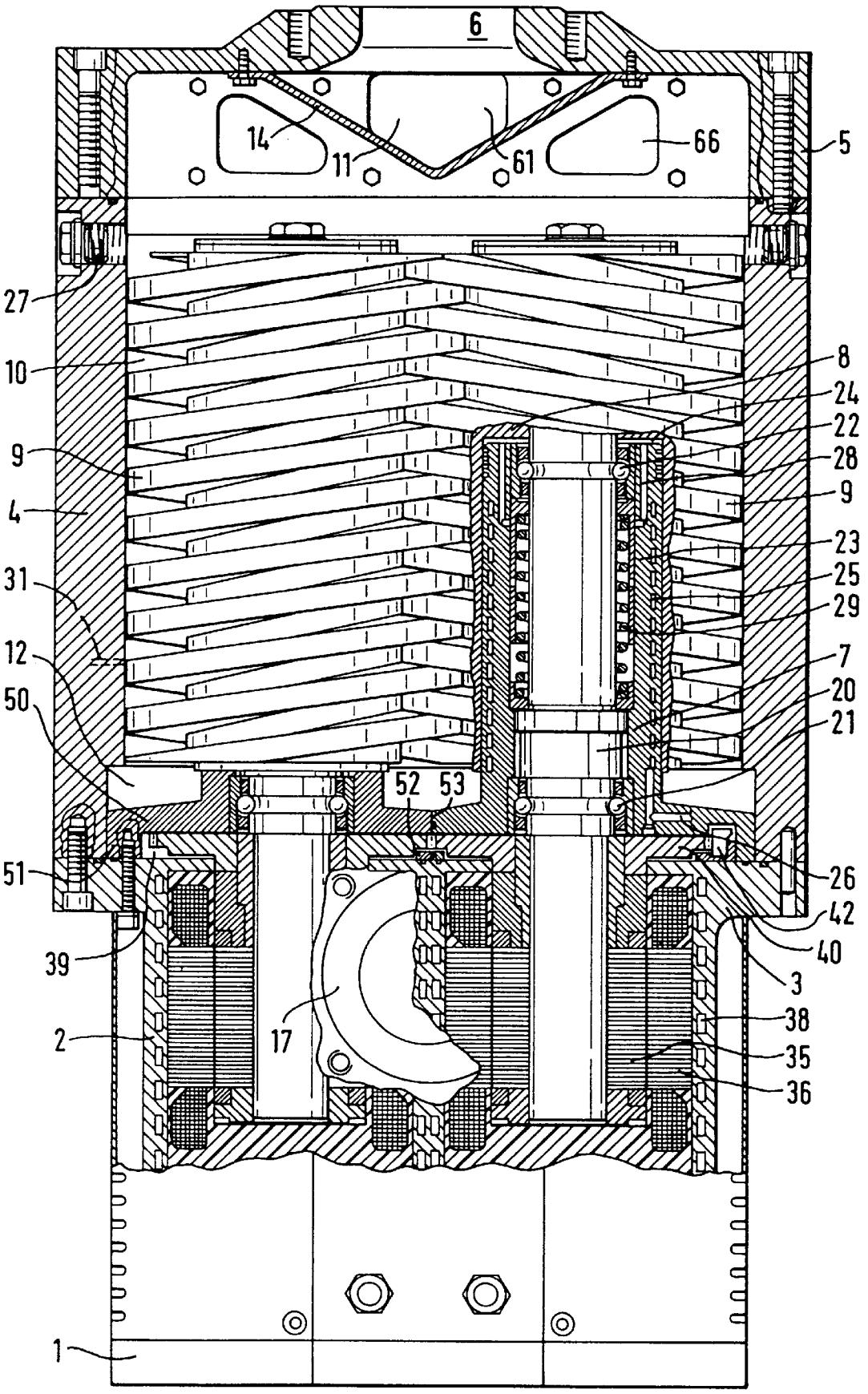
6
14
11
61
66
5
27
10
8
24
22
9
28
9
4
23
31
25
29
12
7
20
50
21
52
53
51
26
42
39
40
3
38
2
17
35
36
1

SCREW COMPRESSOR WITH COOLING

CROSS-REFERENCE TO RELATED APPLICATIONS

This is the national stage of International Application No. PCT/EP96/02631 filed Jun. 18, 1996.

BACKGROUND OF THE INVENTION

In screw-spindle compressors, as disclosed by EP-A 472933, the pressure difference attainable depends to a considerable extent on the leakage losses between the peripheral surfaces, moving relative to one another, of the rotors and the pump-chamber housing. In view of this, the aim will be to keep the clearance between these surfaces as small as possible. However, the operating safety, with due regard to the temperature-induced thermal expansion of the rotors, requires greater clearance.

It is known to directly cool rotors of twin-shaft compressors (EP-A 290664) by a heat-transfer medium (lubricating oil) being provided in a bearing hollow space of the rotor, which heat-transfer medium is cooled by a stationary cooling coil projecting into the bearing hollow space. This has the disadvantage that the bearing hollow space of the rotor has to be sealed off. However, the seals required for this are trouble-prone, in particular at a high number of revolutions. High losses which lead to the generation of heat and jeopardize the cooling effect also arise in the heat-transfer medium, which is swirled between the rotating rotor and the stationary cooling coil.

It is conventional practice to cool the delivered medium by liquid coolant, for example, being injected (U.S. Pat. No. 4,515,540) or by some of the delivered medium being fed back after cooling (DE-A 25 44 082). Such cooling may also be provided in combination with the invention; however, the aim of the invention is to cool the rotor so that the rotor, in particular in the area of the sensitive bearings, can assume a temperature which is below the pressure-side temperature of the delivered medium.

SUMMARY OF THE INVENTION

The object of the invention is therefore to create a screw-spindle compressor of the type described, in which the rotors are cooled independently of the delivered medium in such a way that good preconditions for a small clearance between the rotors themselves as well as between the rotors and the pump-chamber housing are created without requiring trouble-prone seals.

The solution according to the invention is composed of two components, namely firstly the feature that the displacement rotors are cooled to a greater extent on the pressure side than on the suction side and secondly a cooling technique utilizing the special type of construction of the rotor bearing arrangement.

The idea of cooling the rotors to a greater extent on the pressure side than on the suction side is based on the fact that, in these machines, most of the compression heat arises in the pockets located closer to the pressure side and enclosed by the rotors and the pump-chamber housing, since, as a result of the leakage losses and possibly also the preadmission at possibly the same volume, they contain a greater gas mass than the pockets closer to the suction side. If the heat is preferably dissipated from the rotor area close to the pressure side, constant diameter ratios of the rotors over their entire length will be achieved more easily than if the rotors are cooled over their entire length. Here, multi-stage rotors mean those whose screw turns forming the compression pockets orbit the rotor several times, so that a plurality of compression pockets separated from one another in each case on the suction and pressure side are formed over the rotor length. In a three-stage arrangement, the screw turns orbit the associated rotor three times in each case. The stage number may be established in accordance with the respective range of pressure application. At least five stages are preferably used.

For the cooling, the invention uses a special technique adapted to the type of construction. This type of construction requires each displacement rotor to be mounted in a floating manner on a stationary bearing tube surrounding the rotor shaft and at least one rotor-side bearing and projecting into the rotor. Only the bearing tube is directly cooled, while the cooling of the rotor takes place indirectly by the peripheral surfaces, opposite one another, of the rotor and the bearing body being arranged in such a way as to be capable of heat exchange relative to one another. The bearings and the rotor shaft are cooled especially effectively, since they are located inside the bearing tube.

In order to improve the heat transfer between the surfaces, opposite one another, of the rotor and the bearing body, these surfaces may be provided with properties improving the heat exchange. So that the convective heat exchange by means of the air layer located between the surfaces is intensified, the intermediate space should not be connected to the suction side but to the pressure side. The surfaces may also be provided with prominences and depressions which improve the coefficient of heat transfer to the medium located in between. The distance between the two surfaces should be as small as possible. To improve the radiation exchange, such a treatment of the surfaces can be provided that they have a high absorption factor in the area of the heat radiation.

The heat transfer to the surfaces, opposite one another, of the rotor and the bearing body can also be improved by the gas located in between being set in flow motion. For this purpose, the intermediate space can be connected to a gas source. The gas flow may also be used for the heat dissipation if an appropriately low gas temperature (if need be cooling) is selected. In addition, it may possibly perform a sealing function for protecting the bearing and drive area from the admission of the delivery medium or from substances contained in the delivery medium.

The used gas is expediently fed to the pressure side of the machine. To deliver the gas, the interacting surfaces of rotor and bearing body may be equipped with delivery members. It may consequently be unnecessary to provide an external compressed-gas source. This also applies when the fed gas is primarily intended to be used not for cooling purposes but for sealing purposes. The delivery action of the surfaces can be brought about in particular owing to the fact that they are equipped with delivery threads on one side or both sides. Instead or in addition, they may also be of conical design so that the action of the centrifugal force is utilized for the delivery. Such means encouraging the motion of the gas in the intermediate space are also useful for improving the heat transfer when no additional gas feed is provided.

The part of the bearing body projecting into the rotor hollow space is expediently equipped with passages through which cooling fluid flows and which are preferably arranged close to the peripheral surface of the bearing body opposite the rotor.

Since the thermal expansion of the rotor is limited thanks to the cooling according to the invention, the housing may be cooled intensively or at least kept at a predetermined temperature without the risk of the rotor running against the housing due to thermal absorption of the clearance. The efficiency of the pump can be increased by the cooling action exerted in this way on the delivery medium.

It is known in particular in the case of vacuum pumps to allow a gas under higher pressure to flow into the compression cells of the machine in order to cool the delivery medium and/or reduce noise. This technique designated as preadmission is also used with advantage in connection with the invention. For example, cooled gas from a suitable source may be used. An external heat exchanger can be avoided by passing the preadmission gas through a heat exchanger located in the cooling pocket on the housing side. Instead of gas, liquid may also be fed into the pump chamber, which liquid vaporizes there and thereby extracts heat from the delivery medium.

The cooling of the bearing body at least in that area in which the bearing body is affected by the heat of the rotor has the great advantage that rolling bearings may be used which are permanently lubricated with grease and therefore require especially little maintenance and constitute no contamination hazard for the pump chamber.

The abovementioned possibility of equipping the interacting surfaces of rotor and bearing body with delivery members can be utilized to protect the bearing area from foreign substances which could come from the pump chamber. For this purpose, the interacting delivery members are designed with a delivery direction leading out of the rotor hollow space.

Foreign substances, especially substances specifically heavier than the delivery medium, during the feeding of sealing medium also the delivery medium itself, are thereby prevented from penetrating into the rotor hollow space against the delivery direction and from advancing into the bearing and drive area. This action is assisted by the force of gravity.

In an advantageous embodiment, the interacting surfaces are designed as delivery members by at least one of them being provided with a delivery thread. It is also possible for both to be provided with delivery threads. The direction of the thread or threads is selected in such a way that the desired delivery direction results. In another embodiment of the invention, the peripheral surfaces, opposite one another, of the rotor and the bearing body run conically with a diameter increasing in the delivery direction, so that the centrifugal force drives back penetrating substances for instance in the direction of the increasing diameter, that is towards the pump chamber. A plurality of such delivery means (e.g. delivery threads and conicity) may also be combined with one another.

This action is increased by connecting the rotor hollow space to a flushing- or sealing-gas source. Thanks to the delivery action, this source need not be under positive pressure; however, this is not out of the question. The gas may also be used for cooling purposes.

An especially important consequence of the invention is the safety against the ingress of liquid into the bearing and drive area. Consequently, the pump not only becomes insensitive to liquid surge with regard to the sealing action but it can also be specifically flushed, in particular for cleaning. For this purpose, special devices may be provided for the admission of a washing liquid, which serves, for example, to release and flush out impurities deposited on the rotor or housing surfaces. If in the meantime the rotational operating speed cannot be maintained, the rotors should be driven at an appropriately reduced speed. Appropriate control devices can be provided for this. It is especially simple and advantageous to control the rotational speed as a function of torque, since the reduction in the rotational speed then occurs automatically. The reduction in the rotational speed can be slight if relatively small quantities of liquid are merely injected into the gas-delivery flow. The greater the proportion of liquid in the filling of the delivery spaces, the lower will be the rotational speed when driving as a function of torque. Complete flooding of the pump chamber may even be provided as long as the low rotational speed then possible and the delivery action still present here in the intermediate space between rotor and bearing body are sufficient in combination with the geodetic height of the bearing body inside the rotor to prevent the overflow of the flushing liquid into the bearing area.

Safety against the passage of liquid in both the operating state and the state of rest can be achieved by the invention. The force of gravity and the pressure difference act in both states and the delivery members additionally act in the operating state.

The invention is explained in more detail below with reference to the drawing, which illustrates a longitudinal section through an advantageous exemplary embodiment.

DESCRIPTION OF THE PREFERRED EMBODIMENT

Resting on the foot part 1 is the motor housing 2, which is connected, if need be in one piece, at the top to the flange-like base plate 3 on which the pump-chamber housing 4 is mounted. The latter is closed off at the top by a lid 5 which contains a suction opening 6.

Fastened to the base plate 3 in a manner to be explained later are the flange plates 50 of the bearing bodies 7, which in each case serve to carry a rotor 8, the periphery of which has displacement projections 9 which are preferably arranged as a two-start helix and engage like the meshing of teeth in the delivery hollow spaces 10 between the displacement projections 9 of the adjacent rotor. In addition, the displacement projections 9 interact at the periphery with the inner surface of the pump-chamber housing part 4. The rotors 8 are connected at the top to the suction space 11 and at the bottom to the pressure space 12.

The pressure space 12 is connected to a pressure outlet (not shown). These parts are provided at the bottom end of the vertically mounted pump-chamber housing.

Each rotor 8 is connected in a rotationally locked manner to a shaft 20 which is mounted at the bottom in the bearing body 7 by a permanently lubricated rolling bearing 21. A second, likewise permanently lubricated rolling bearing 22 is located at the top end of a tubular part 23 of the bearing body 7, which projects into a concentric bore 24 of the rotor 8, which bore 24 is open towards the bottom, i.e. on the pressure side. This bearing 22 is preferably located above the centre of the rotor 8. The tubular part 23 of the bearing body preferably extends through most of the length of the rotor 8. In a vertical arrangement of the pump, the end of the tubular part 23 lies substantially higher than the pressure outlet 17. This helps to protect the bearing and drive region from the ingress of liquid or other heavy impurities from the pump chamber.

Provided in the tubular part 23 of the bearing body are cooling passages 25 which are connected via passages 26 to a cooling-water source and via corresponding passages (not shown in the drawing) to a cooling-water discharge. The cooling passages 25 are preferably formed by helical turned recesses which are tightly covered by a sleeve. The cooling of the rotor bearings prolongs the service life or the maintenance intervals of these bearings if they are permanently lubricated with grease. Furthermore, the peripheral surface of the tubular part 23 of the bearing body is also kept at a low temperature by the cooling. This peripheral surface is opposite the inner peripheral surface of the hollow space 24 of the rotor at a slight distance apart. These surfaces are designed in such a way that they are capable of good heat exchange and therefore heat can be dissipated from the rotor indirectly via the tubular part 23 of the bearing body and its cooling devices 25. The surfaces, opposite one another, of the tubular part 23 of the bearing body and the rotor hollow space 24 may be designed in a suitable manner in order to improve the heat exchange between them. For example, they may be treated or burnished in such a way that the radiation exchange is promoted by high absorption coefficients. The convective heat exchange by means of the gas layer in between may be improved by a small surface spacing and a suitable surface structure which leads to the increase in the coefficient of heat transmission. For this purpose, one surface or both surfaces may be designed with a coarse finish or with heat-exchange ribs or threads or the like. It is also possible to feed a sealing gas to the rotor hollow space 24 through the bearing body or the shaft 20, which sealing gas is discharged with the delivery medium from the pressure space 12. Apart from the sealing of the bearing region, it can also serve to additionally cool the bearing, the bearing body and the rotor, but in this case it is expediently not directed through the bearing or bearings in order not to contaminate the latter but is directed via a passage 28 forming a bypass.

To protect the bearing and drive area from inflows penetrating from the pump chamber, suitable sealing and/or barrier devices are provided. It is especially advantageous to equip the opposite surfaces of the bearing body 23 and the inner surfaces of the rotor hollow space 24 with a delivery thread (not shown) on one side or both sides, which delivery thread exerts a delivery effect from the rotor hollow space 24 towards the pressure space 12. This delivery effect mainly acts on solid or liquid particles on account of their higher density and thereby prevents their ingress into the bearing and drive area. The delivery thread is expediently designed in such a way that this effect is still active even at a considerably reduced rotational speed.

The delivery effect can also be brought about by the gap between rotor and bearing body widening conically towards the pressure space. Here, the gap width (distance of the surface of the bearing body from the surface of the rotor) remains essentially constant. In addition, the surfaces opposite one another may also be provided in this case with a delivery thread on one side or both sides, but this is not necessary.

Since the equipping of the gap between rotor and bearing body with a delivery thread or conicity acting in a delivering manner provides a very effective seal against the ingress of liquid or solid particles, additional sealing devices may often be dispensed with; however, they may be provided, and in fact preferably in a non-contact or minimum-contact type of construction, e.g. labyrinth seals or piston-ring-like seals.

On account of the sealing action of the delivery thread or the gap conicity, the pump according to the invention is insensitive to the presence of liquid in the pump chamber as long as the rotors are rotating. This insensitivity also exists in the stationary state owing to the high bearing arrangement in the rotor as long as the liquid in the pump chamber does not reach the bearing level. It is not only important when the delivery medium carries a liquid surge with it but may also be utilized for cleaning and/or cooling the pump by liquid injection. For example, cleaning or cooling liquid can be injected through nozzles, of which one is indicated at 27. The same or separate nozzles 27 may be used for injecting the cleaning liquid and the cooling liquid.

If very severe contamination has to be expected, it is possible to constantly inject cleaning liquid during operation. During the operation of a vacuum pump, the cleaning liquid, provided it can pass into the pump chamber, should have a vapour pressure below the intake pressure. If the pump is a multi-stage pump and the contamination (for example as a function of pressure) settles mainly in the second and/or following stages, it is possible to limit the injection of the cleaning liquid to the second or following stage and to thereby separate it from the suction side.

In most cases, however, the cleaning operation does not take place constantly but periodically if a requirement for cleaning (for example as a result of an increase in the drive torque) is established. Owing to the insensitivity of the pump to liquids, relatively large liquid quantities may then also be used. If the rotational operating speed cannot be maintained on account of the quantity or type of cleaning liquid used, the rotational speed may be reduced accordingly. Suitable control devices are provided for this. For example, the rotational speed may be controlled as a function of the drive torque, which automatically leads to a corresponding reduction in the rotational speed relative to the rotational operating speed at increased power requirement. The continuous rotation of the rotors even during the cleaning phase not only serves to seal the rotor bearing arrangement but also conveys the effect of the cleaning liquid to the contaminated surfaces.

The delivery action in the gap between rotor and bearing body may also be utilized to deliver sealing gas independently of an external compressed-gas source. However, to deliver the sealing gas, the action of such a compressed-gas source will generally be preferred in order to feed the sealing gas independently of the rotor speed. Cooling of the housing shell is not necessary in all cases. However, in the context according to the invention it is advantageously possible, since the rotors 8 are also cooled and their thermal expansion is therefore limited. It need not be feared that the rotors run against the housing only because they expand, while the housing is kept at a lower temperature.

The pump according to the invention may be provided with preadmission. This means that passages 31 are provided in the areas of higher, or possibly even average, compression in the housing, through which passages 31 gas of higher pressure than corresponds to the compression state in this area of the pump chamber is let into the pump chamber in order to effect cooling and/or noise reduction according to known principles. According to an advantageous feature of the invention, the preadmission gas can be extracted directly from the pressure side of the pump by being cooled.

The rolling bearings 21, 22 in the example shown are angular-contact ball bearings which are set against one another by a spring 29. Each shaft 20 carries the armature 35 of the drive motor below the bearing 21, preferably directly, i.e. without an intermediate coupling, the stator 36 of which drive motor is arranged in the motor housing 2. The motor housing may be provided with cooling passages 38.

The flange plates 50, which in the example shown are made in one piece with the bearing bodies 7, are mounted with their outer margins 51, which essentially follow the periphery of the pump-chamber housing 4, and their abutting inner margins 52 on the top side of the base plate 3. The flange plates 50 are sealed relative to the base plate 3. The end faces 53, which follow a secant in radial section and at which the flange plates 50 bear against one another, are also provided with a sealing insert.

A turned recess is provided below the flange plates 50 between the margins 51, 52, which turned recess encloses with the top side of the base plate 3 a space 39 which serves to accommodate synchronization gear wheels 40 which are arranged in a rotationally locked manner with known means on the shafts 20 between the bearings 21 and the motor armatures. So that they can mesh with one another in the area of the inner margins 52 of the flange plates 50, the inner margins have a cut-out at an appropriate point, through which cut-out the gear wheels reach. Remaining below this cut-out on each side is a web to which the reference line of the reference numeral 52 generally designating the inner margin points in FIG. 1. This web is advantageous not only for stability reasons but also because it permits an encircling seal on the one hand relative to the base plate 3 and on the other hand between the flattened secant faces of the flange plates 50.

The turned-out portions 39 in the flange plates 50 have a diameter which is greater than the diameter of the synchronization gear wheels 40. They are arranged with slight eccentricity in relation to the inner margins 52 so that the synchronization gear wheels 40 can be inserted upon assembly of the rotor construction units despite the presence of the sealing web at 52.

Since the space 39 containing the synchronization gear wheels 40 is completely separate from the pump chamber, there is no risk of the synchronization gear wheels becoming contaminated. They are merely used for the emergency synchronization of the rotors. Their teeth normally do not come in contact with one another. Lubrication is therefore unnecessary as a rule. Although it may be used if desired, the dry running of the synchronization gear wheels simplifies the construction, since sealing between the space 39 and the drive motors is not necessary.

The synchronization gear wheels 40 may also serve as pulse generator discs or may be supplemented by additional pulse generator discs which are scanned by sensors 42, of which one is shown in FIG. 1. These sensors 42 are connected to a control device which monitors the respective rotary position of the rotors relative to a set point and corrects it via the drive. This concerns electronic synchronization of the rotors, which is known as such and therefore need not be explained in more detail here. The play between the teeth of the synchronization gear wheels 40 is slightly smaller than the flank clearance between the displacement projections 9 of the rotors 8. However, it is greater than the synchronization tolerance of the electronic sychronization device. During proper functioning of the latter, therefore, neither the flanks of the displacement bodies 9 nor the teeth of the synchronization gear wheels 40 come in contact with one another. In the event of the latter nonetheless coming in contact with one another, they are provided with a wear-resistant and if need be slidable coating.

The performance data of the pump, apart from being determined by the drive output and rotational speed, are determined by the displacement or delivery volume formed at the rotors and thus by the length of the rotors. The delivery data may therefore be altered by altering the length of the pump part containing the rotors. A series of pumps having different performance data is therefore preferably distinguished by the fact that the individual pumps of this series differ through graduation of the length of these parts, to which the pump-chamber housing, the rotors and if need be the tubular parts, projecting into the rotors, of the bearing bodies belong.

It will be recognized that each rotor forms with the associated bearing and drive devices a construction unit which can be mounted independently and, apart from the rotor, consists of the bearings 21, 22, the bearing body 7, the cooling devices provided therein, the shaft 20, the synchronization gear wheel 40, the associated sensor 42 and the motor armature 35. These units are inserted into the pump in a completely preassembled manner. They can easily be removed from the base plate 3 or inserted after removal of the pump-chamber housing. The exchanging of these units can therefore be left to the user, whereas the manufacturer takes care of the maintenance of the sensitive units as such.

The pump is preferably of isochoric type of construction so that larger liquid quantities can also be safely delivered.

We claim:

1. A screw compressor having two screw rotors comprising a suction side, a pressure side and a rotor shaft, a stationary bearing tube mounting a rotor on the pressure side thereof and enclosing the rotor shaft, and at least one rotor-side bearing enclosed by the bearing tube, said bearing tube protruding into the rotor and having a peripheral surface in confronting relationship with a complementary surface of the rotor, said bearing tube being actively cooled by a fluid forced to flow through a cooling passage, said peripheral and complementary surfaces being arranged in such a way as to be capable of heat exchange relative to one another whereby the rotor is cooled to a greater extent on the pressure side than on the suction side by virtue of the fact that the part of the bearing tube protruding into the rotor is cooled by said heat exchange.

2. Compressor according to claim 1, characterized in that an intermediate space is provided between the peripheral and complementary surfaces of the rotor and the bearing tube and said space is connected to the pressure side.

3. Compressor according to claim 1, characterized in that at least one of the said peripheral and complementary surfaces is provided with an irregular surface having prominences and depressions that increase the heat transfer area, the improving the heat exchange with a medium located in between.

4. Compressor according to claim 1, characterized in that the said peripheral and complementary surfaces are provided with a surface finish having high absorption factor for heat radiation.

5. Compressor according to claim 1, characterized in that at least the part of the bearing tube projecting into the rotor contains passages through which cooling liquid flows.

6. Compressor according to claim 5, characterized in that the cooling passages are arranged close to the peripheral surface of the bearing tube opposite the rotor.

7. Compressor according to claim 1, characterized in that a slight clearance is provided between the peripheral and complementary surfaces and said surfaces are designed as delivery members interacting in a non-contacting manner and having a delivery direction leading out of the rotor.

8. Compressor according to claim 7, characterized in that it is arranged essentially vertically with an outlet opening situated in a geodetically low position.

9. Compressor according to claim 7, characterized in that the peripheral and complementary surfaces opposite one another are of conical design with a diameter increasing in the delivery direction.

10. Compressor according to claim 1, characterized in that a bore of the rotor is provided and is connected to a sealing-gas source, solid sealing-gas providing a sealing function by its flow.

11. Compressor according to claim 7, characterized in that means are provided for the control of the rotor drive as a function of torque.

12. Compressor according to claim 11, characterized in that means are provided for the admission of a washing liquid to the rotor.

* * * * *

UNITED STATES PATENT AND TRADEMARK OFFICE

CERTIFICATE OF CORRECTION

PATENT NO. : 5,924,855

DATED : July 20, 1999

INVENTOR(S) : Dahmlos et al

It is certified that error appears in the above-identified patent and that said Letters Patent is hereby corrected as shown below:

Claim 3, column 8, line 37, delete "the" (first occurrence) and insert --thus--.

Claim 10, column 8, line 63, delete "solid" and insert --said--.

Signed and Sealed this

Nineteenth Day of December, 2000

*Attest:*

Q. TODD DICKINSON

*Attesting Officer*

*Commissioner of Patents and Trademarks*